United States Patent [19]

Ellis

[11] 4,155,326

[45] May 22, 1979

[54] MINE SAFETY INSPECTION INDICATOR

[76] Inventor: Clifford E. Ellis, 9661 Lindenbrook St., Fairfax, Va. 22030

[21] Appl. No.: 933,835

[22] Filed: Aug. 15, 1978

[51] Int. Cl.[2] ..... B41F 31/14; G07C 3/00; G09F 9/00

[52] U.S. Cl. ..... 116/307; 40/109; 101/354; 116/309; 116/321; 346/78

[58] Field of Search ..... 116/135, 164 H; 40/109; 101/354; 346/78, 104

[56] References Cited

U.S. PATENT DOCUMENTS

| | | | |
|---|---|---|---|
| 1,711,981 | 5/1929 | Andres et al. | 116/135 |
| 2,868,293 | 1/1959 | Kearse | 40/107 X |
| 3,431,845 | 3/1969 | Hooper | 101/78 |
| 3,436,015 | 4/1969 | Bradford | 116/135 X |
| 3,599,224 | 8/1971 | Hahn | 346/61 |
| 3,709,144 | 1/1973 | Sims | 346/104 X |
| 4,058,079 | 11/1977 | Taylor et al. | 116/114 H |

*Primary Examiner*—Daniel M. Yasich

*Attorney, Agent, or Firm*—Shlesinger, Arkwright, Garvey and Dinsmore

[57] ABSTRACT

A mine safety inspection indicator including a plurality of rotatable wheels having indicia printed on one side thereof and attached to a panel having windows therein so that the indicia is selectively visible through the windows, and further including slideable indicators whose position is correlated with indicia for giving further information, the wheels and slideable indicators including printing members cooperable with recording paper and a pressure member so as to provide a permanent record of a mine safety inspection; the device also includes a slideable warning panel which may be moved to a position out of view or moved to a visible position for giving a warning of a dangerous condition in a mine.

7 Claims, 4 Drawing Figures

MINE SAFETY INSPECTION INDICATOR

This invention relates to a mine safety inspection indicator, and more particularly relates to a mine safety inspection indicator which provides a record of a mine safety inspection, gives a visible indication of the results of each inspection, and also provides a warning in the event that a dangerous condition exists in a mine.

BACKGROUND AND OBJECTS

Since the "Federal Coal Mine Health and Safety Act of 1969" was passed by Congress, stringent requirements have been placed upon coal mine operators to insure the safety of miners working in the coal mines. Such requirements include a number of standards which must be met before a mine may be operated, and also include a number of requirements to insure the safety of those working in the mine.

One such requirement is that a mine examiner must inspect the mine within three hours immediately preceeding the beginning of any shift and before any miner in that shift enters the active working area of the coal mine. The mine examiner must examine every working section and make tests in each working section to determine accumulations of methane, quantity of air passing through the mine, and other safety related inspections. The mine examiner is required to place his initials and the date and time of the inspection at all places which he examines. Further, if the examiner finds a condition which constitutes a violation of the required health or safety standards which would be hazardous to persons entering the mine, he is required to post a "danger" sign which is conspicuously visible to persons entering the hazardous places in the mine.

As a result of such requirements, in the past mine examiners have made the required record of inspection by using a piece of chalk and writing the date, time, and his initials on various portions of the mine such as the mine walls, mine roof supports, roof bolts, cross bars, paperbags, equipment, roof, etc. This of course complies with the requirements of the Act, but is a rather undersirable manner of compliance both for the inspectors and the mine workers as well. In time, the walls, equipment, supports, and the like may become cluttered with such recordings or alternatively the chalk must be wiped off a rather dirty surface.

The danger sign which must be posted also can create problems since it must be of course readily visible and not capable of being easily erased such as by someone brushing against a chalk writing.

However, this manner of compliance with the Act has continued as it does at least minimally meet the requirements of the Act.

The present invention, on the other hand, provides a far more acceptable indication of the results of an inspection and simultaneously maintains a printed record of the inspection in addition to the visible indication of the inspection. The device may be posted throughout the mine in the required areas, and additionally incorporates a danger or warning sign to readily alert the mine workers to the presence of a dangerous condition.

Accordingly, it is a primary object of the present invention to overcome the disadvantages of the prior art inspection records.

Another object of the invention is to provide a changeable indication of each inspection which complies with the requirements of the Federal Coal Mine Health and Safety Act of 1969.

Still a further object of this invention is to provide a device for giving a visible indication of the results of an inspection and simultaneously making a permanent record thereof.

DESCRIPTION OF THE DRAWINGS

These and other objects and advantages of the invention will become apparent in light of the following description and claims when taken together with the acompanying drawings in which:

DESCRIPTION OF THE INVENTION

Figure 1:
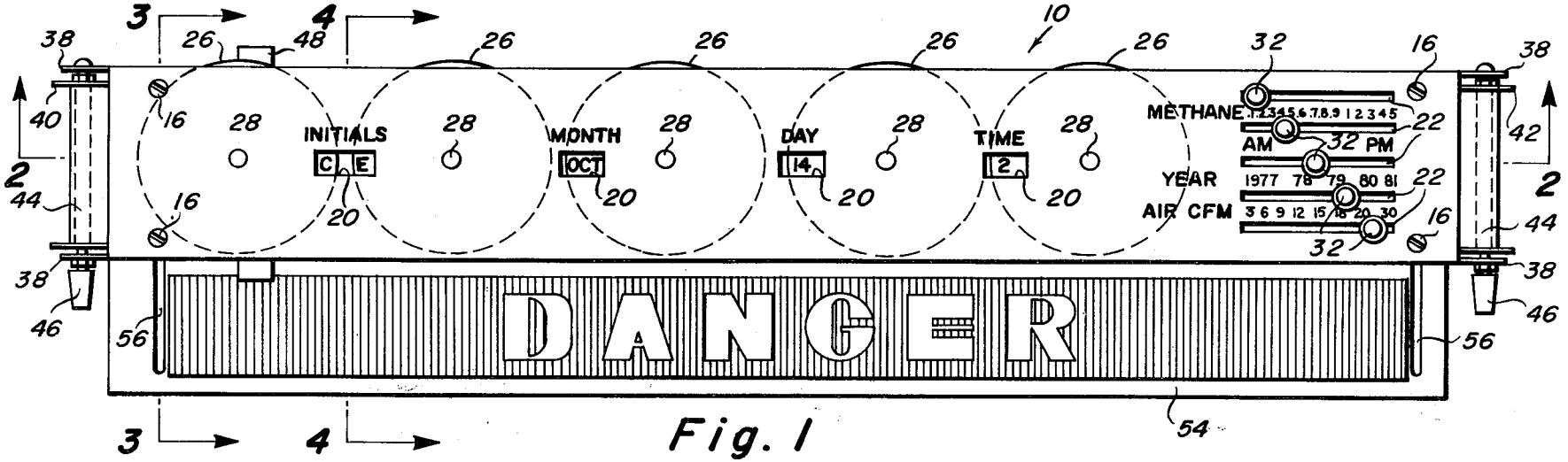
FIG. 1 is a plan view of the invention.
Figure 2:
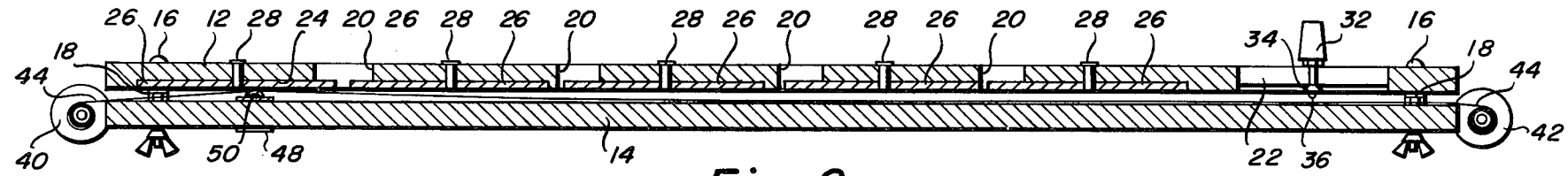
FIG. 2 is a longitudinal cross section along the lines 2—2 of FIG. 1 and viewed in the direction of the arrows.
Figure 4:
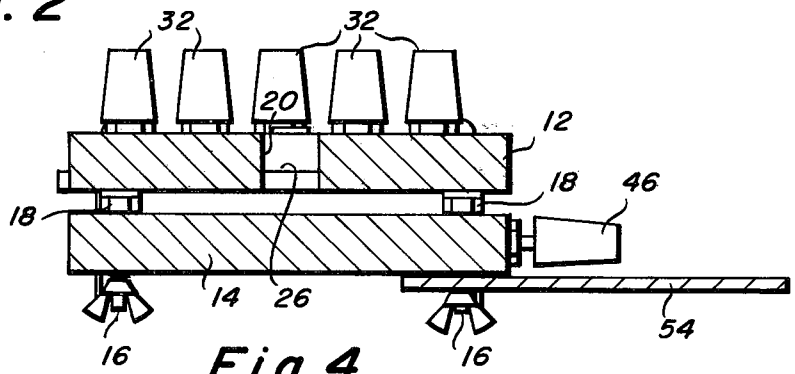
FIG. 4 is a transverse section along lines 4—4 of FIG. 1 and viewed in the direction of the arrows.

Referring now to the drawings, the mine safety inspection indicator generally designated 10 is seen to include a front panel 12 and a rear panel 14, the panels being secured together by means of a plurality of bolts 16 and suitable spacers 18 around the bolts 16. Preferably, the spacers 18 may be coil springs.

The front panel 12 is provided with a plurality of window openings 20, and suitable indicia is provided above each window 20 to provide an indication of what that window represents, such as the initials of the examiner, the month, the day and the time as shown. In addition, a plurality of slots 22 are provided and likewise have labeling indicia for providing an indication of the quanity of methane, the time of day, the year, and the volume of air as shown.

The back side of the front panel 12 is provided with recesses 24 in which are mounted wheels 26. The recesses 24 are of such a depth that the wheels 26 are substantially flush with the back side of the panel 12. The wheels 26 are secured in the recesses 24 by means of a pivot pin 28 so that the wheels 26 are rotatable in the recesses 24.

On the rear of the wheels 26 are provided printing characters 30 which are preferably raised characters which extend slightly beyond the back side of the panel 12.

In the slots 22 are provided a plurality of slideable indicators 32 retained therein by means enlarged heads 34. On the enlarged heads 34 are provided raised printing elements 36.

At each end of the indicator 10 are provided a pair of bosses 38 secured to the rear panel 14. The bosses serve to mount spools 40 and 42. Spool 40 is for example a supply spool while spool 42 is a take up spool for recording paper 44 which extends from the supply spool 40 between the panels 12 and 14 to the take up spool 42. Knobs 46 are provided on the spools 40 and 42 for turning the spools and advancing the recording paper 44 through the indicator 10.

A pressure member 48 is provided with a pressure applying surface 50 which presses the recording paper 44 into engagement with the back side of the panel 12 and with the raised printing characters 30 and the printing elements 36. The pressure element 48 is provided with a pair of U-shaped spring elements 52 at the end thereof which encircle the rear panel 14.

Figure 3:
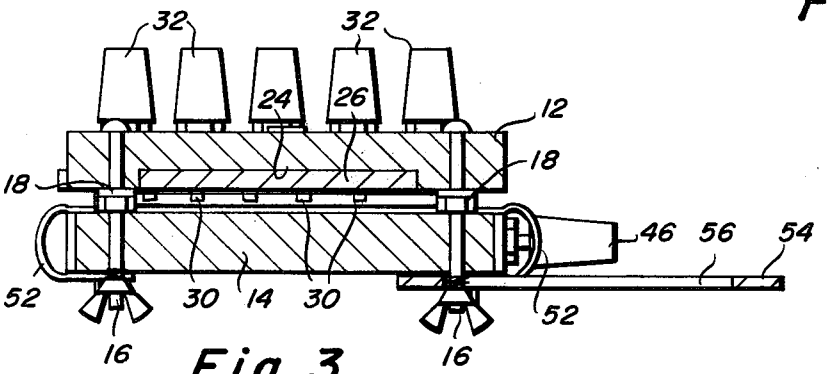
FIG. 3 is a transverse cross section along lines 3—3 of FIG. 1 and viewed in the direction of the arrows.

A "danger" display board 54 is provided with a pair of elongate slots 56 near the ends thereof. Two of the bolts 16 pass through the slots 56 as seen in FIG. 3, so that the danger board 54 may be visible as seen in FIG. 1 or may be retracted to a position behind the rear panel 14 were it is not visible.

OPERATION

In operation, after a mine examiner has made his inspection of the mine, he turns the appropriate wheels or dials 26 to indicate first his initials in one window, the month in the next window, the day in the next window, and the time in the last window. Thereafter, the slideable indicators 32 are adjusted to indicate the quanity of methane present, whether the inspection was made in the morning or evening, the year of the inspection, and the volume of air passing through the mine at that point. Thereafter, the pressure element 48 is slid along the rear panel 14 completely across all of the printing characters and printing elements. This urges the recording paper 40 into engagement with the respective printing elements and creates an impression on the paper. Preferably, the paper is a so called "carbon-less" copy paper, although other types of recording paper will be usable as is readily apparent. The actual initials, month, day and time are printed on the recording paper in an aligned sequence so as to be clearly visible on the paper when it is removed from the indicator. The other printing characters on the wheels 26 will be out of alignment by virtue of their having been rotated away from the window, and thus the appropriate record will be readily apparent. In addition, the position of the marks made by the printing elements 36 will be indicative of the settings of the indicators 32. Of course other types of printing characters may be utilized to give a record of the actual value instead of just providing position marks indicative of the value.

If after his inspection the mine examiner finds that a dangerous condition exists such as a high methane content in the air, the danger board 54 is slid downwardly exposing the warning message thereon.

After an inspection has been recorded on the recording paper 44, the take up spool 42 is rotated by knob 46 so as to advance the recording paper 44 in preparation for the next mine inspection. When the take up spool 42 is full, it may be removed and stored for future reference. The apparatus is then loaded with a full spool of paper and is ready for reuse.

While this invention has been described as having a preferred design, it will be understood that it is capable of further modification. This application, is therefore, intended to cover any variations, uses, or adaptations of the invention following the general principles thereof and including such departures from the present disclosure as come within known or customary practice in the art to which this invention pertains, and as may be applied to the essential features hereinbefore set forth and fall within the scope of this invention or the limits of the claims.

What is claimed is:

1. A mine safety inspection indicator comprising:

front and rear panels secured together, a plurality of window openings in said front panel, a plurality of rotatable wheels having first indicia printed on one side thereof and attached to the backside of said front panel so that said indicia is selectively visible through said window openings, raised printing characters on the other side of said wheels, said printing characters corresponding to said indicia on said one side of said wheels, a plurality of elongated slots in said front panel and second indicia denoting mine conditions on said front panel and adjacent said slots, a slideable indicator in each of said slots positionable along said second indicia and having a printing element on the backside thereof, a pressure member slideable along said rear panel, recording paper extending substantially coextensively with said panels and positioned between said pressure member and said printing character and said printing elements, whereby sliding of said pressure member along said rear panel will cause said printing characters and said printing elements to print on said recording paper and produce a record of the first indicia visible through said windows and the second indicia corresponding to the position of said slideable indicators.

2. A mine safety inspection indicator as in claim 1 and wherein:

said recording paper comprises a selectively advanceable continuous strip.

3. A mine safety inspection indicator as in claim 2 and including:

a supply roll for said recording paper mounted at one end of said panels and a take-up roll for said recording paper at the other end of said panels.

4. A mine safety inspection indicator as in claim 3 and including:

means for rotating said take-up roll for drawing unused recording paper into position for printing thereon.

5. A mine safety inspection indicator as in claim 1 and including:

a display board attached to said rear panel, said display board being movable between a first position wherein said display board is concealed behind said panels and a second position wherein said display board is visible towards the front of said panels, said display board having a warning indicator thereon.

6. A mine safety inspection indicator as in claim 5 and wherein:

said display board includes transverse elongate slots near the ends thereof and is secured to said rear panel by means of fastners passing through said slots.

7. A mine safety inspection indicator as in claim 1 and wherein:

said wheels are positioned in recesses in the backside of said front panel so as to be substantially flush therewith and said printing characters extend above the surface of the backside of said front panel.

* * * * *